US009603409B2

(12) United States Patent
Blowers

(10) Patent No.: US 9,603,409 B2
(45) **Date of Patent: *Mar. 28, 2017**

(54) CUSTOMIZABLE REPLACEMENT STRAP CONVERTER SYSTEM FOR FLIP FLOP SANDALS

(71) Applicant: Kymberly Blowers, Las Vegas, NV (US)

(72) Inventor: Kymberly Blowers, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/194,975

(22) Filed: Jun. 28, 2016

(65) Prior Publication Data

US 2016/0302511 A1 Oct. 20, 2016

Related U.S. Application Data

(63) Continuation-in-part of application No. 13/923,240, filed on Jun. 20, 2013, now Pat. No. 9,402,436.

(60) Provisional application No. 61/662,032, filed on Jun. 20, 2012.

(51) Int. Cl.

| | |
|---|---|
| ***A43B 3/12*** | (2006.01) |
| ***A43B 1/00*** | (2006.01) |
| ***A43B 23/24*** | (2006.01) |
| ***A43B 3/24*** | (2006.01) |
| ***A43B 3/00*** | (2006.01) |
| ***A43B 3/10*** | (2006.01) |

(52) U.S. Cl.

CPC ..... *A43B 3/122* (2013.01); *A43B 1/0054* (2013.01); *A43B 3/0078* (2013.01); *A43B 3/103* (2013.01); *A43B 3/244* (2013.01); *A43B 23/24* (2013.01)

(58) Field of Classification Search

CPC ..... A43B 3/0078; A43B 3/244; A43B 3/248; A43B 3/103; A43B 3/10; A43B 3/122; A43B 3/12; A43B 1/0054

USPC ..... 36/11.5, 100, 101

See application file for complete search history.

(56) References Cited

U.S. PATENT DOCUMENTS

| | | | | |
|---|---|---|---|---|
| 3,928,927 | A * | 12/1975 | Brown | A43B 3/122 12/142 S |
| 3,978,596 | A * | 9/1976 | Brown | A43B 3/122 12/142 S |
| 8,020,319 | B1 * | 9/2011 | Mohaupt | A43B 3/122 36/101 |
| D732,807 | S * | 6/2015 | Collins | D2/916 |
| 9,402,436 | B2 * | 8/2016 | Blowers | A43B 3/244 |
| 2007/0245597 | A1 * | 10/2007 | Krutilek | A43B 3/103 36/101 |
| 2013/0091732 | A1 * | 4/2013 | Mendoza | A43B 3/0078 36/100 |
| 2014/0165426 | A1 * | 6/2014 | Chapin | A43B 3/103 36/100 |

FOREIGN PATENT DOCUMENTS

| | | | | |
|---|---|---|---|---|
| FR | 2973655 | A1 * | 10/2012 | A43B 3/122 |

* cited by examiner

*Primary Examiner* — Ted Kavanaugh

(57) ABSTRACT

A customizable replacement strap converter system for flip flop sandals provides the ability to convert flip flop sandals into lace-up sandals. Converter pegs are inserted into a stock sandal sole after the stock straps have been removed. A plurality of straps is then threaded through loop bands of the converter pegs in order to create a custom strap arrangement 21.

2 Claims, 8 Drawing Sheets

CUSTOMIZABLE REPLACEMENT STRAP CONVERTER SYSTEM FOR FLIP FLOP SANDALS

The current application is a continuation-in-part (CIP) application of a U.S. non-provisional application Ser. No. 13/923,240 filed on Jun. 20, 2013. The U.S. non-provisional application Ser. No. 13/923,240 claims a priority to a U.S. provisional application Ser. No. 61/662,032 filed on Jun. 20, 2012.

FIELD OF THE INVENTION

The present invention relates generally to footwear. More particularly, the present invention relates to a system for converting standard flip-flop sandals into customizable lace-up sandals.

BACKGROUND OF THE INVENTION

Footwear refers to garments worn on the feet, primarily for protection against the environment and for fashion. Many different styles and mindsets regarding footwear have existed over many centuries and across many cultures. Some ancient cultures such as the Egyptians, Hindu and Greeks did not regard footwear as an essential garment and often went barefoot, though the Egyptians and Hindus were known to occasionally don ornamental footwear, such as a sole-less sandal known as a "Cleopatra." Other cultures, such as the Romans, considered footwear as visual signs of social and economic status and power, while going about barefoot was an indicator of poverty on the level of slaves and peasants.

Sandals are an open type of outdoor footwear, consisting of a sole held to the wearer's foot by straps passing over the instep and occasionally over the ankle. Sandals may take many different forms but the common understanding is that a sandal leaves a large portion of the upper foot exposed, particularly the toes. Conventional foot sandals ordinarily include a platform with straps extending across the platform and permanently secured within the platform structure. The foot is then slipped into the strap so as to provide a means of holding the foot to the platform. Sandals have been very popular for many years, and are widely used indoors and outdoors, usually in warmer weather and climates. During the past decades, sandals have been increasingly considered a popular design accessory, so that a pair of sandals is selected by the user to blend well aesthetically with other clothing to be worn by the user, coordinating the "look" of the sandals with those clothes. Sandals may, however, be expensive, and when styles change, previously purchased sandals become obsolete, and the user may feel the need to purchase a new pair to keep up with the latest style trend.

Many different types of sandals exist, including clogs, fisherman sandals, geta, Grecian sandals, and thong sandals or "flip-flops." Flip flops are one of the most common types of sandals, where two ends of a Y-shaped strap are attached to the sole of the sandal on the opposite sides of the sole where a wearer's foot would rest, with the two ends intersecting at a thong or toe piece extending from the sole for placement between the big or first toe and the second toe of the wearer's feet. This configuration of sandal straps contributes to the common name of "flip-flops" due to the slapping of the sole against the heel that occurs while walking.

It has been proposed in the past to manufacture sandals and shoes with interchangeable and removable elements, but these prior art devices are normally quite complicated and difficult to provide for the interlocking of the elements. The present invention provides for a method to customize thong sandals which is very simple and provides for a method to quickly and easily replace the original straps with any configuration of straps, laces, embellishments, or charms the user may desire.

It is therefore an object of the present invention to provide an apparatus which allows the user to replace the Y-shaped strap of a typical pair of thong or flip-flop sandals with custom straps laces, embellishments, charms or other accessories.

DETAIL DESCRIPTIONS OF THE INVENTION

Figure 1:
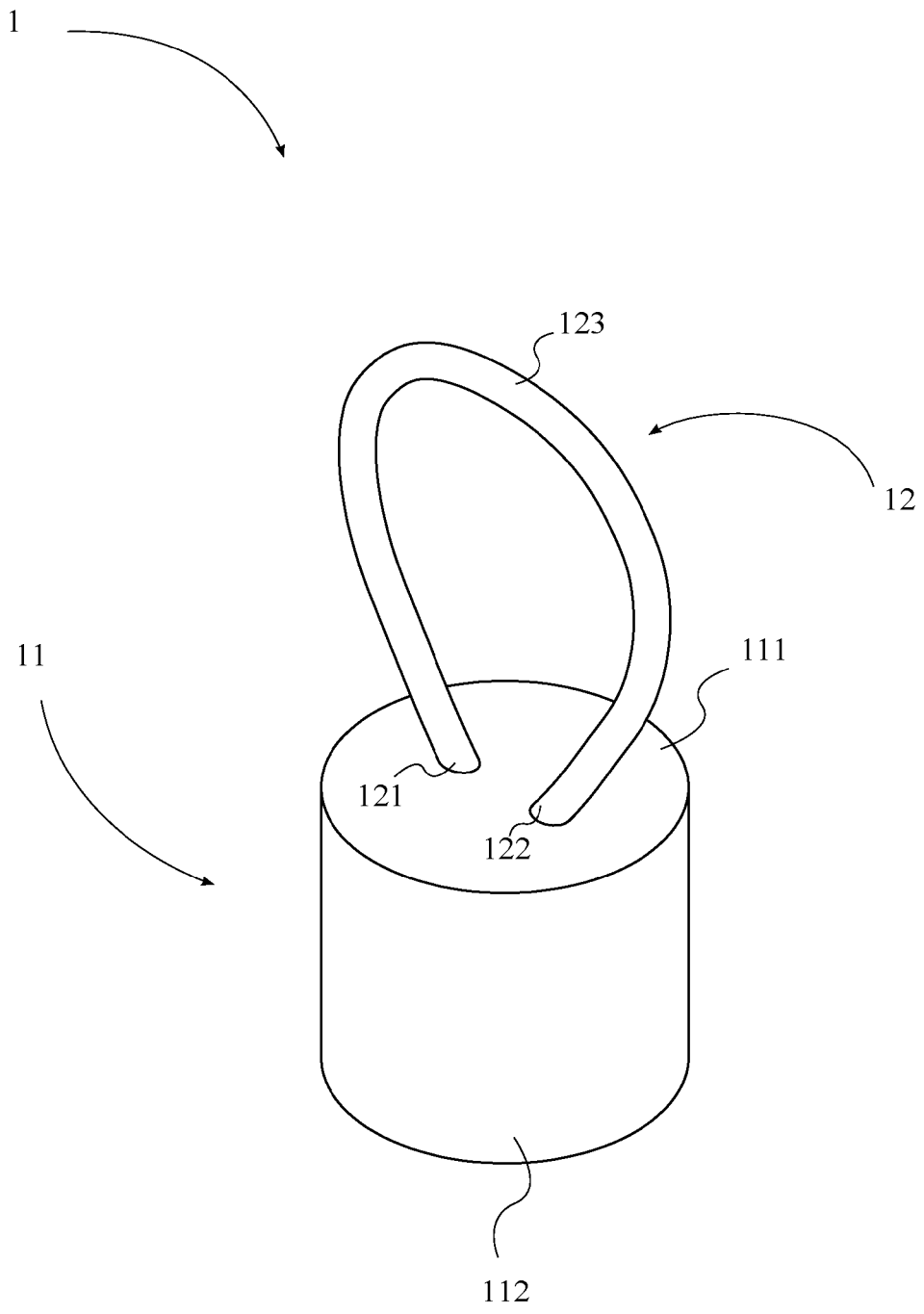
FIG. 1 is a perspective view of a first embodiment of one of the converter pegs.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

The present invention is an apparatus for the conversion of standard Y-strap sandals or thongs into customizable lace-up sandals. The present invention generally comprises a plurality of converter pegs 1 and a plurality of straps 2. The plurality of converter pegs 1 and the plurality of straps 2 are installed onto a sandal sole 3 from a pair of pre-existing flip-flop sandals from which the stock y-strap or other strap arrangement has been removed, resulting in a plurality of empty peg apertures 31 traversing through the sandal sole 3 into which the plurality of converter pegs 1 may be inserted, enabling the plurality of straps 2 to be threaded through loop bands 12 of the converter pegs 1 in a customizable lace-up strap arrangement 21.

Referring to FIG. 1, in the preferred embodiment, each of the plurality of converter pegs 1 comprises a top face 111, a cylindrical body 112, and a loop band 12. The cylindrical body 112 and the top face 111 constitute a converter peg body 11. In the preferred embodiment of the present invention, the converter peg body 11 is made from injection molded plastic or another relatively stiff polymer. The loop band 12 is made from a soft, flexible plastic, nylon or other polymer, various types of fabric or another appropriate material that is soft, pliable, comfortable and safe for extended skin contact.

The top face 111 is positioned on the cylindrical body 112, wherein the top face 111 and the cylindrical body 112 are concentrically positioned with each other. The cylindrical body 112 is positioned adjacent to the top face 111 opposite the loop band 12.

In a first embodiment of the present invention, the perimeter of the top face 111 has an equal diameter to the diameter of the cylindrical body 112. This embodiment is appropriate for use with sandal soles whose peg apertures do not traverse entirely through the sandal sole, and rather have a portion of material flush with the top of the sandal sole with a smaller diameter than the peg aperture, so that the converter pegs 1 are blocked from completely being pushed through the peg apertures in the sandal sole.

Figure 2:
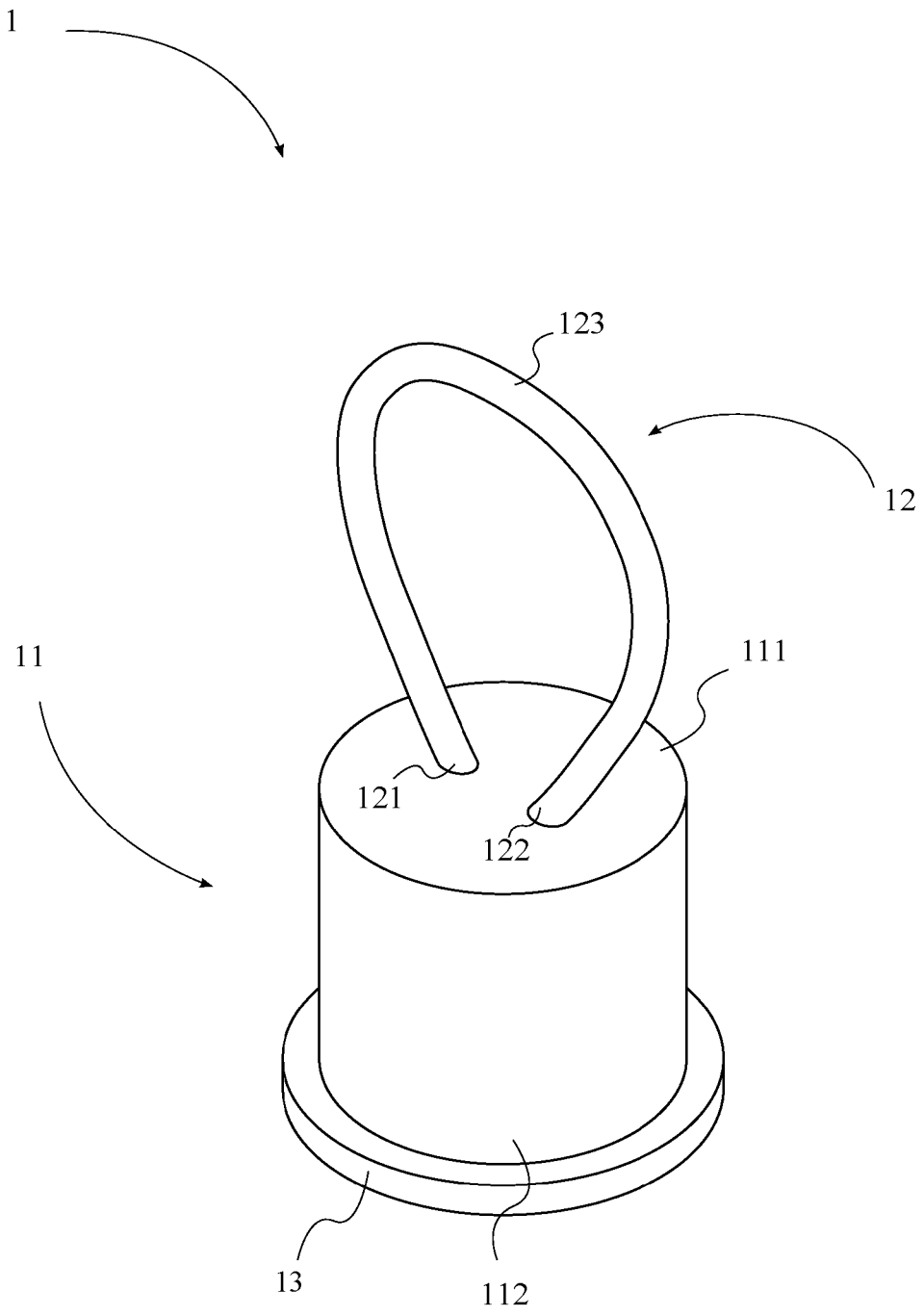
FIG. 2 is a perspective view of a second embodiment of one of the converter pegs.
Figure 5:
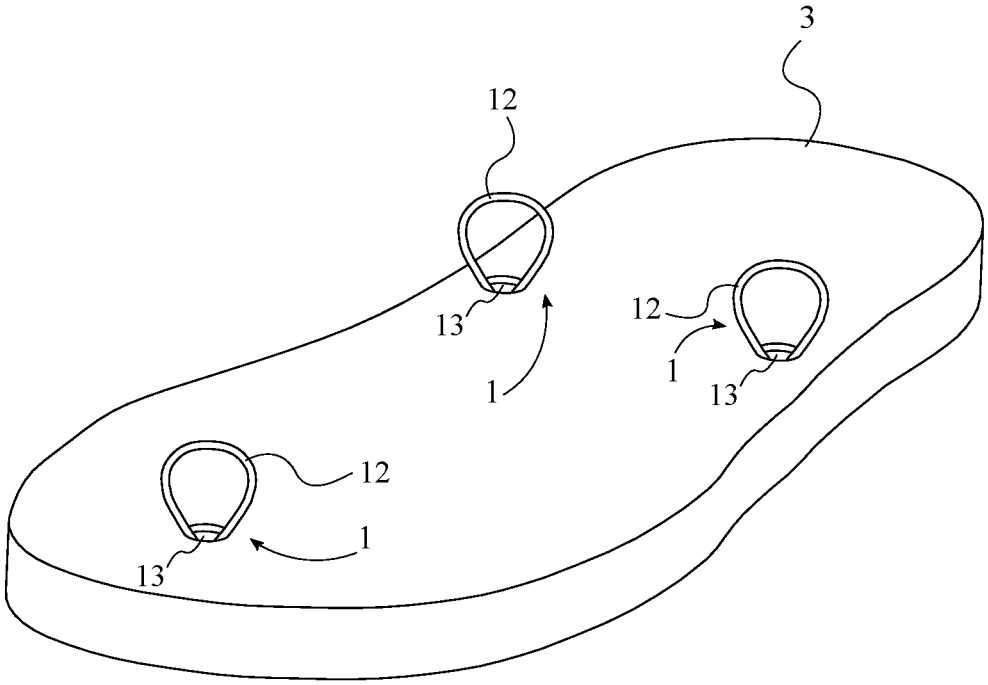
FIG. 5 is a perspective view of the sandal sole with the plurality of converter pegs installed.

In a second embodiment of the present invention shown in FIGS. 2 and 5, each converter peg further comprises a lip 13. The lip 13 has a diameter greater than that of the cylindrical body 112, and is concentrically connected to the cylindrical body 112 opposite the top face 111 along the cylindrical body. This embodiment is appropriate for sandal soles whose peg apertures are simply cylindrical holes through the sandal sole. Thus, the lip 13 abuts against the bottom of the sandal sole, preventing the converter pegs 1 from traversing completely through the sandal sole when in use.

The loop band 12 is perpendicularly attached to the top face 111 opposite the cylindrical body 112. The loop band 12 comprises a first loop end 121, a second loop end 122, and a medial loop portion 123. The first loop end 121 and the second loop end 122 are positioned adjacent to each other, and are attached to the top face 111. The medial loop portion 123 is positioned between the first loop end 121 and the second loop end 122. The loop band 12 of each converter peg 1 provides a connection point through which to insert one end of one of the straps 2 in order to create a customized strap arrangement 21.

In the preferred embodiment of the present invention, the converter peg body 11 and the loop band 12 are manufactured such that the loop band 12 is permanently attached to the converter peg body 11, wherein the loop band 12 is oriented perpendicular to the converter peg body 11. In an alternate embodiment of the present invention, a converter peg is assembled from a length of cord that is attached at its ends to make a cord end junction by tying a knot, melting the ends together, or affixing them together with adhesive or similar means, and pushing the loop band 12 through a cord aperture in the converter peg body 11 smaller than the cord end junction. In another embodiment, the cord end junction of the loop band 12 are prevented from passing through the cord aperture by affixing an o-ring, split washer, crimp cover, or any combination of o-rings, split washers and crimp covers between the cord end junction and the cord aperture.

Figure 3:
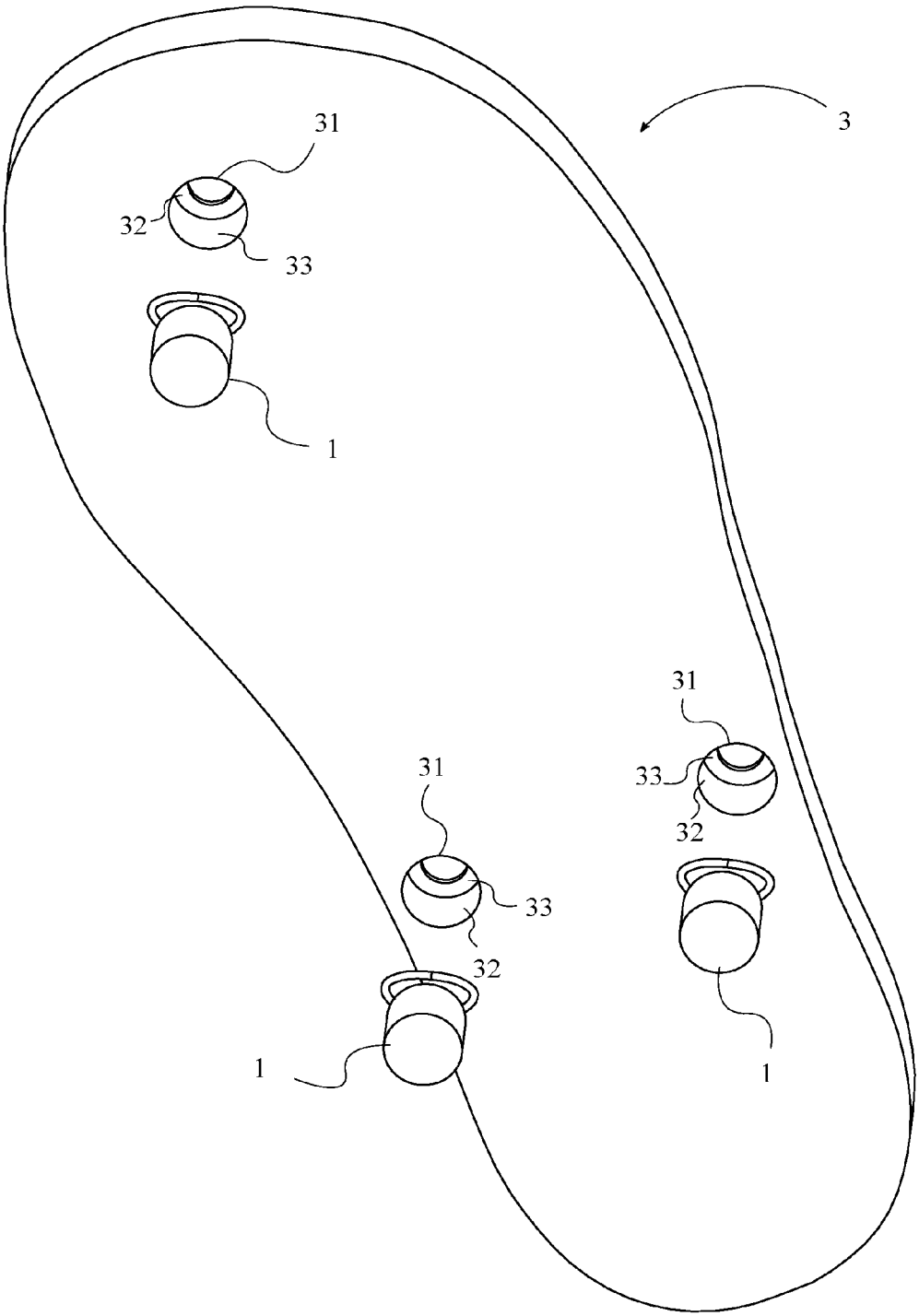
FIG. 3 is an exploded lower perspective view of the sandal sole and the first embodiment of the plurality of converter pegs.
Figure 4:
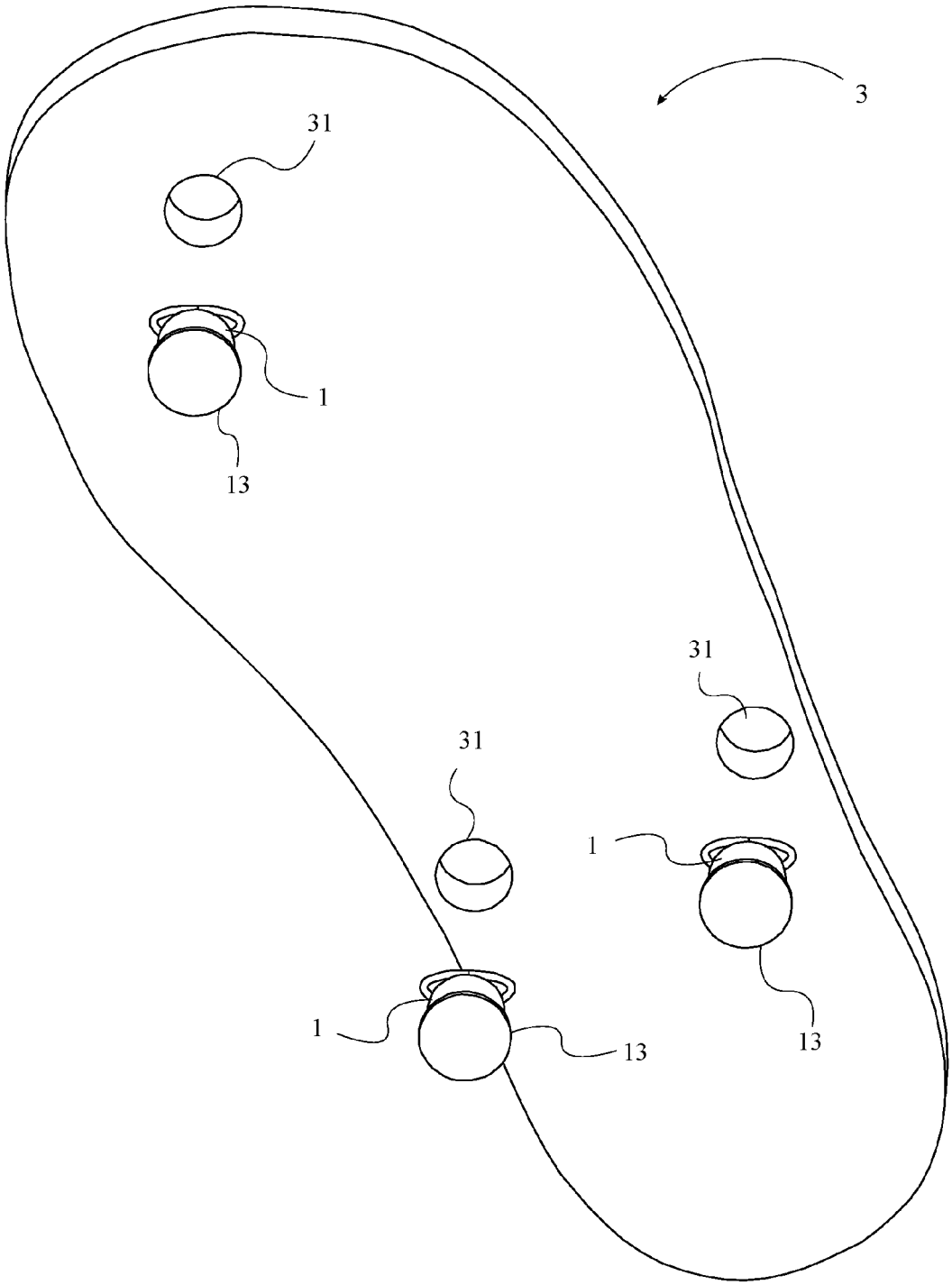
FIG. 4 is an exploded lower perspective view of the sandal sole and the second embodiment of the plurality of converter pegs.

Referring to FIGS. 3-5, the present invention is intended for use with an existing sandal sole 3 whose stock y-strap or other strap arrangement 21 has been removed, leaving a plurality of peg apertures 31 traversing through the sandal sole 3. The sandal sole 3 may be from an existing flip-flop sandal from which pre-installed straps have been removed or a standalone sandal sole 3. Each of the plurality of peg apertures 31 has typical dimensions of flip-flop sandal soles, or atypical dimensions. The quantity of converter pegs 1 to be utilized with a single sandal sole 3 is equal to the quantity of peg apertures 31 present in the sandal sole 3 to be used with the present invention.

In a typical sandal sole 3, the plurality of peg apertures 31 traverses through the sandal sole 3, wherein the plurality of peg apertures 31 is positioned around the sandal sole 3 according to a typical flip-flop sandal arrangement. In the typical flip-flop sandal arrangement, a first peg aperture from the plurality of peg apertures 31 is positioned approximately between a user's first toe and second toe, and a second peg aperture and a third peg aperture from the plurality of peg apertures 31 are positioned opposite each other across the instep area of a user's foot.

In a first type of sandal sole to be considered herein for use with the present invention, each of the plurality of peg apertures 31 comprises a first aperture portion 32 and a second aperture portion 33. The first aperture portion 32 and the second aperture portion 33 are concentrically positioned with each other and are positioned adjacent to each other. A first aperture diameter for the first aperture portion 32 is larger than a second aperture diameter for the second aperture portion 33, forming a peg aperture T shape. This type of sandal sole is appropriate for use with the previously disclosed first embodiment of the present invention, wherein the converter peg body 11 of each of the converter pegs 1 is strictly cylindrical.

In a second type of sandal sole to be considered herein for use with the present invention, each of the plurality of peg apertures does not comprise the second aperture portion 33, wherein in the second type of sandal sole, the first aperture portion is cylindrical and traverses entirely through the sandal sole 3. The second type of sandal sole is appropriate for use with the previously disclosed second embodiment of the present invention, wherein the converter pegs further comprise the lip 13 which prevents the converter pegs 1 from being pulled entirely through the sandal sole 3 when being installed or during use.

In order to utilize the present invention, each of the converter pegs 1 is inserted into one of the peg apertures 31 of a pre-existing sandal sole 3. The converter pegs 1 may be configured to be removable from the peg apertures 31, or the converter pegs 1 may be permanently fixed into the peg apertures 31 through any useful and appropriate means such as, but not limited to, an adhesive material, stitching, melting the converted pegs 1 and the sandal sole 3 together, or other means. The converter peg body 11 and each of the plurality of peg apertures 31 have approximately equal dimensions, such that the converter peg body 11 may be removably inserted into one of the plurality of peg apertures 31 by applying a small force, and friction between the converter peg body 11 and the one of the plurality of peg apertures 31 prevents the converter body from accidentally becoming dislodged from the one of the plurality of peg apertures 31.

In the first embodiment used with the first type of sandal sole, the second aperture portion 33 blocks the converter peg 1 from being pulled completely through the sandal sole 3 during use. Alternatively, in the second embodiment used with the second type of sandal sole, the lip 13 blocks the converter peg 1 from being pulled completely through the sandal sole 3. Preferably, when the converter pegs 1 are inserted into the peg apertures 31, a lower extremity of the converter peg body 11 opposite the top face 111 of each of the converter pegs 1 is flush with a bottom surface of the sandal sole 3. This is not a strict requirement, however. In one variation of the second embodiment comprising the lip 13, the peg apertures 31 further comprise a recessed portion with a larger diameter than the main portion of the peg aperture, equal to the diameter of the lip 13, positioned at the bottom of the sandal sole 3, with the same height at the lip 13, in order to accept the lip 13 so that the bottom of the lip 13 is flush with the bottom of the sandal sole 3.

Figure 6:
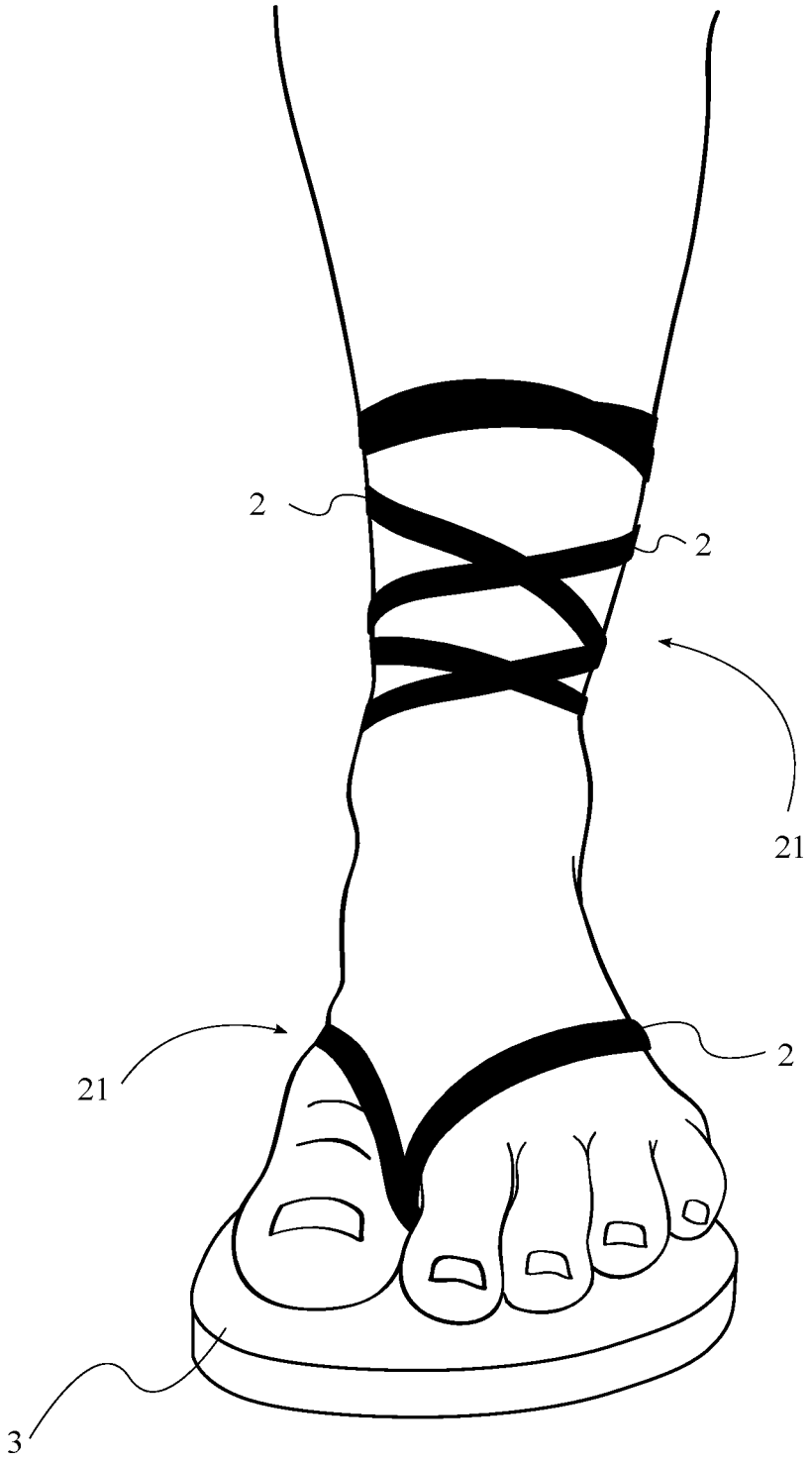
FIG. 6 is a front view of the present invention in use having a strap arrangement using only the plurality of straps.
Figure 7:
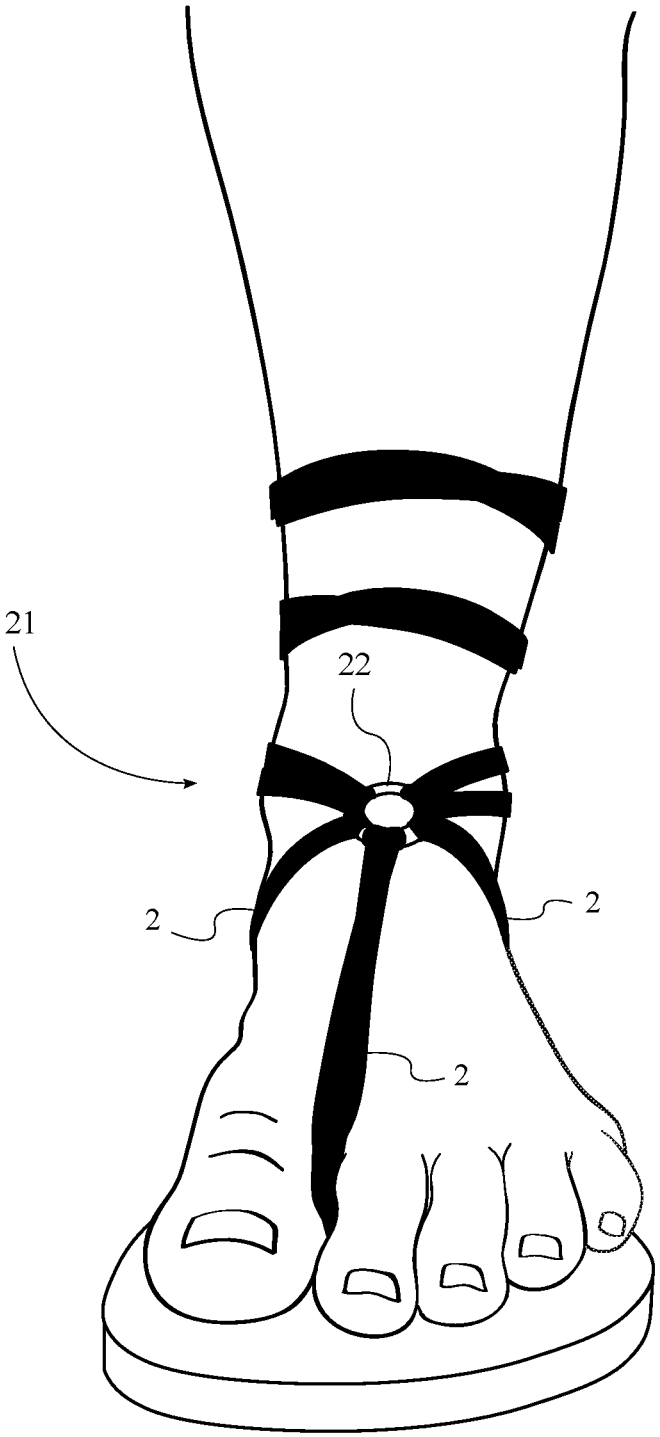
FIG. 7 is a front view of the present invention in use having a strap arrangement incorporating the strap tie ring.

Referring to FIGS. 6-7, the plurality of straps 2 is used to create a custom strap arrangement 21 when the present invention is installed onto a sandal sole. In one embodiment, the strap arrangement 21 further comprises a strap tie ring 22. Each of the straps 2 is removably attached to the loop band of at least one of the of converter pegs 1. More particularly, in one embodiment, each of the straps 2 is removably attached to the medial loop portion 123 of one of the converter pegs 1. Each of the straps 2 may be comprised of lengths of fabric, cord, string, or any other elongated strip of material the user may wish to utilize. The strap tie ring 22 is an optional accessory. The straps 2 may be attached or connected to the loop bands 12 by any relevant means. In most cases, the straps 2 will be threaded through the loop bands 12. It is contemplated, however, that the straps may be permanently affixed onto the loop bands 12 through any useful means, such as, but not limited to: gluing, taping, stitching, or utilizing mechanical fasteners such as pins, staples, or clamps.

Figure 8:
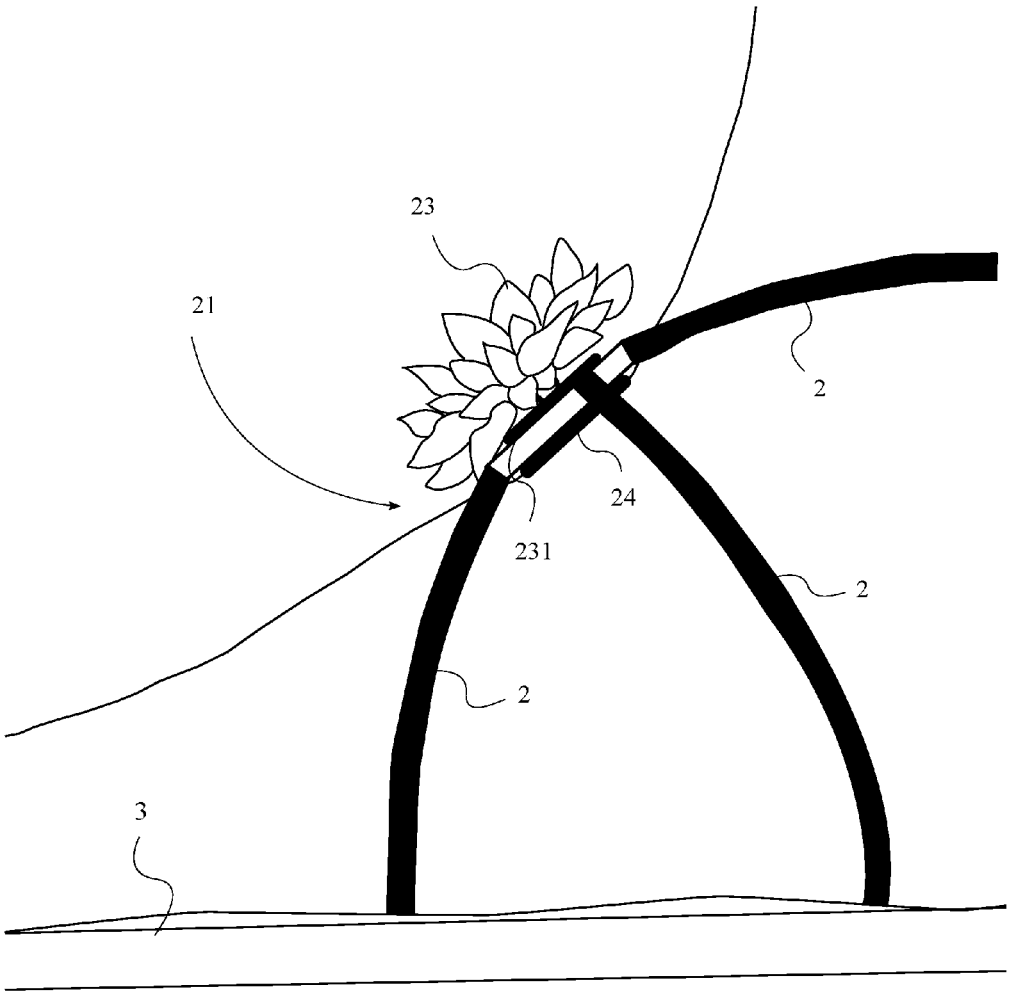
FIG. 8 is a side view of the present invention in use having a strap arrangement incorporating the strap tie ring, embellishment and embellishment connection magnet.

Generally, to utilize the present invention to create a customized strap arrangement 21 on a pre-existing sandal sole 3, the user threads each of the straps 2 through the loop band 12 of one of the converter pegs 1, places their foot atop the sandal sole 3, and proceeds to wrap the plurality of straps 2 around their foot and lower leg in any desired manner. A decorative embellishment 23 and a strap tie ring 22 are optional for creating the customized strap arrangement 21. The user may additionally incorporate rings, charms or other additional embellishments into the strap arrangement 21 as the user desires. For example, the user may arrange and thread the laces through the loops and around the foot in such a way that a ring may be held in place by the laces on the top of the foot near the instep Referring to FIG. 7, if the user wishes to include the strap tie ring 22, the user simply threads one or more of the plurality of straps 2 through the strap tie ring 22 in any configuration the user desires. Referring to FIG. 8, if the user wishes to include the decorative embellishment 23 in the customized strap arrangement 21, the user may first position a magnetic backing 231 concentrically with the strap tie ring 22, between the strap tie ring 22 and the user's foot. The user then positions the decorative embellishment 23 adjacent to the strap tie ring 22 that the embellishment connection magnet 24 is positioned adjacent to the strap tie ring 22 opposite the magnetic backing 231. The embellishment connection magnet 24 is thereby removably connected with the decorative embellishment 23 by the magnetic backing 231. In the preferred embodiment of the present invention, the embellishment connection magnet 24 and the magnetic backing 231 protrude toward each other within the strap tie ring 22 in order to close the gap due to separation by the strap tie ring 22 so that the embellishment connection magnet 24 and the magnetic backing 231 are in physical contact, ensuring a secure connection. In alternate embodiments of the present invention, the decorative embellishment 23 may be removably connected to the strap tie ring 22 by other means, such as, but not limited to, hook and loop tape, hooks, or snaps. In another embodiment, the strap tie ring 22 itself is magnetic and the magnetic backing 231 is not necessary.

To use the present invention to convert a typical pair of flip-flop sandals into a pair of customized sandals with a customized strap arrangement 21, the user cuts or otherwise removes an existing strap setup from a pair of typical flip-flop sandals, inserts the converter pegs 1 into the peg apertures 31, steps into the sandals and connects the strap arrangement 21 to the plurality of converter pegs 1 as previously described. In one embodiment where the converter pegs 1 are removable from the sandal sole 3, the converter pegs 1 and the straps 2 are only connected to any given sandal sole 3 temporarily, as the strap arrangement is the only means of preventing the plurality of converter pegs 1 from sliding out from the bottom of the sole. After the user unlaces or otherwise removes the strap arrangement 21, the user may easily remove the plurality of converter pegs 1 and subsequently install the present invention in a different sandal sole 3, to achieve a different look by using a sandal sole 3 with a different color or pattern, for example.

Although the invention has been explained in relation to its preferred embodiment, it is to be understood that many other possible modifications and variations can be made without departing from the spirit and scope of the invention as hereinafter claimed.

What is claimed is:

1. A customizable replacement strap converter system for flip flop sandals comprises:

a plurality of converter pegs, wherein each of the plurality of converter pegs is configured to be inserted into a peg aperture of a sandal sole;

a plurality of straps;

each of the plurality of converter pegs comprises a cylindrical body, a top face, and a loop band;

the loop band of each converter peg comprises a first loop end, a second loop end, and a medial loop portion;

the first loop end and the second loop end being attached to the top face adjacent to each other;

the medial loop portion being positioned between the first loop end and the second loop end; and each of the plurality of straps being removably attached to the loop band of at least one of the converter pegs, wherein the plurality of straps can be attached to the plurality of converter pegs to create a customizable strap arrangement on a sandal sole.

2. The customizable replacement strap converter system for flip flop sandals as claimed in claim 1, wherein each of the plurality of straps is removably attached to the medial loop portion of one the plurality of converter pegs.

* * * * *